US005622194A

United States Patent [19]

Ledda-Vengerder

[11] Patent Number: 5,622,194

[45] Date of Patent: Apr. 22, 1997

[54] HAIRBAND

[75] Inventor: Marie-Thérèse Ledda-Vengerder, Allonnes, France

[73] Assignee: Pippa Promotions B.V., Woudenberg, Netherlands

[21] Appl. No.: 298,143

[22] Filed: Aug. 30, 1994

[30] Foreign Application Priority Data

Mar. 4, 1994 [DE] Germany ..... 9403661 U
Mar. 7, 1994 [WO] WIPO ..... DM/028 958

[51] Int. Cl.[6] ..... A42C 5/02; A45D 8/36

[52] U.S. Cl. ..... 132/273; 2/181

[58] Field of Search ..... 132/273, 275; D28/39, 40, 41, 42, 43; 2/171, 171.4, 171.5, 181, 209.3, 174, 338

[56] References Cited

U.S. PATENT DOCUMENTS

| | | | |
|---|---|---|---|
| D. 254,637 | 4/1980 | Moore | D2/230 |
| 1,176,910 | 3/1916 | Lee | 132/273 |
| 1,897,146 | 2/1933 | Richardson | 2/171 |
| 2,679,711 | 6/1954 | Learnard | 2/209.3 X |
| 3,081,781 | 3/1963 | Stermer | 132/273 |
| 5,377,360 | 1/1995 | Fleitman | 2/181 |
| 5,379,782 | 1/1995 | Tabb | 132/275 |

*Primary Examiner*—Todd E. Manahan
*Attorney, Agent, or Firm*—Darby & Darby

[57] ABSTRACT

A hairband having a band portion and two end portions is provided. One of the end portions comprises an elastic loop portion or female portion. The other end portion comprises a narrow portion and an adjacent, wider, engaging male portion. In its relaxed state, the loop portion has an inside diameter that is smaller than the male portion. With the hairband formed in this manner, the two ends can easily be connected. The male portion is pushed through the loop portion, expanding the loop portion. Once the male portion is through, the loop portion relaxes, contracting around the narrow portion.

11 Claims, 1 Drawing Sheet

FIG. 1
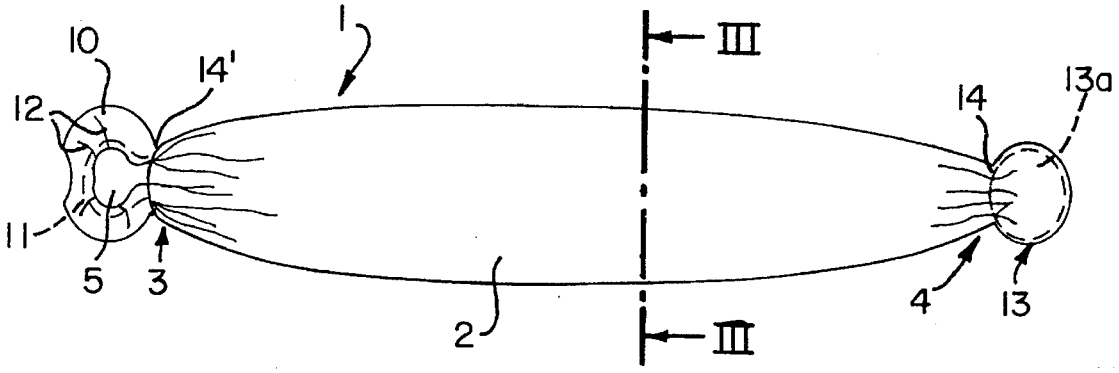
FIG. 2
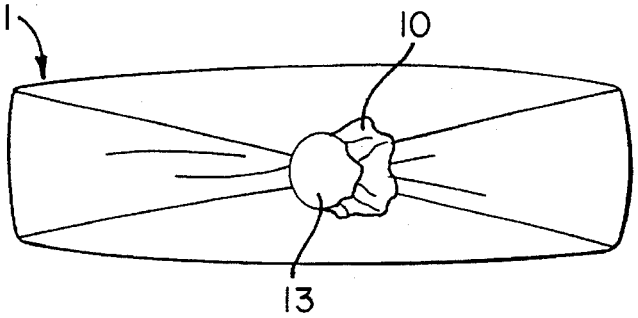
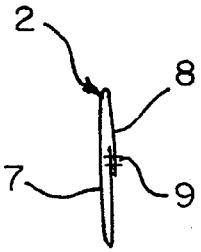
FIG. 3
FIG. 4
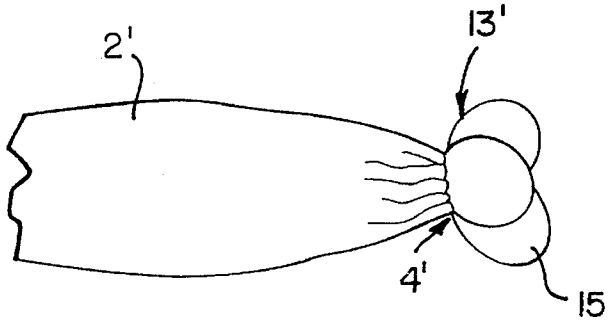

HAIRBAND

BACKGROUND OF THE INVENTION

The present invention relates to a novel hairband, and more particularly, to a hairband having two interlocking ends.

Hairbands are used in the creation of a variety of hairstyles. While they are primarily used for keeping a wearer's hair in a certain position or in a certain style, hairbands may also be worn simply as jewelry. In either case, it is desirable that the hairband remain in a set position on the head or hair.

To that end, there are several types of hairbands available. One common hairband is comprised of a strip of material having two ends that the user ties together in a knot. Very often, however, the hairband slips out of its desired position while being knotted. Further, the knot is very often relatively thick and not very attractive. A user may also clip the ends together with a hairclip. However, the hairclip is often awkward to use and may take away from the look of the hairstyle.

Another type of hairband available is one that is made of a stretchable material in the form of a closed ring. Such hairbands can be used with a variety of hairstyles; however, a user may have difficulty adjusting the size of the hairband to fit a particular style.

SUMMARY OF THE INVENTION

It is an object of this invention to provide a hairband that can be used with a variety of hair styles.

It is another object of this invention to provide a hairband that is simple to use so that hair will not slip out of position when the hairband is being positioned.

The present invention provides a hairband having a band portion and two end portions. One of the end portions comprises an elastic loop or female portion. The other end portion comprises a narrow portion and an adjacent engaging male portion. In its relaxed state, the loop portion has an inside diameter that is smaller than the male portion. With the hairband formed in this manner, the two ends can be easily connected. The male portion is pushed through the loop portion, expanding the loop portion. Once the male portion is through, the loop portion relaxes, contracting around the narrow portion.

The connection is so easily made that a user does not have to make visual contact with the connecting point. A user simply works the hairband in with any of the endless possibilities of hairstyles. As soon as the hair is in its proper style, the ends of the hairband are connected to each other so that the hairband can reliably remain in its desired position.

BRIEF DESCRIPTION OF THE DRAWINGS

The foregoing and other features of the present invention will be more readily apparent from the following detailed description of preferred embodiments taken in conjunction with the attached drawings wherein:

FIG. 1 is a top view of the novel hairband;

FIG. 2 is a front view of the hairband with its ends connected;

FIG. 3 is a sectional view of the novel hairband of FIG. 1 taken along III—III; and FIG. 4 is a second embodiment of the novel hairband.

DETAILED DESCRIPTION OF PREFERRED EMBODIMENTS

FIG. 1 illustrates the preferred embodiment of the present invention. Referring to the figure, the novel hairband 1 is comprised of a band portion 2 having a first end 3 and a second end 4. The band portion 2 is preferably made from an elastic material. In this way, the user can more easily adjust the tension of the hairband 1 when tying it around a portion of hair or the head. Further, since the amount of hair to be tied together varies from hairstyle to hairstyle, the length of the hairband 1 necessary to tie it together also varies. The elasticity of the band portion 2 provides a means to compensate for length variations. Band portion 2, preferably 45 to 55 cm. in length, should have an elasticity sufficient to lengthen it by at least 30% if a sufficient force is applied. If the hairband is to be used for children, the length of the band portion 2 should be shorter.

Referring now to FIG. 3, band portion 2 is formed from a single piece of material. The sides of the material are folded inwardly to form two layers of material 7 and 8, thus forming a flattened tube. The edges of the folded sides are then connected to each other by a seam 9. It is preferable that the band portion 2 be made in this manner to avoid an undesirable curling-up of its side edges. Also, the two layers of material 7 and 8 add strength to the hairband 1. Finally, the two layers add volume to the hairband 1, improving its appearance. The band portion 2 also may be provided with a lining (not shown), further increasing the strength of the hairband 1.

Referring again to FIG. 1, an elastic female portion or loop portion 10 is fastened to the first end 3 of the band portion 2. The loop portion 10 is preferably formed in the same manner as the band portion 2, that is, from one piece of material with sides inwardly folded and connected with a seam to form a flattened tube. Further, the loop portion 10 is preferably made from the same material as the band portion 2 to provide a uniform appearance.

The width of the loop portion 10 is preferably one fifth to one third the width of the band portion 2. Inside loop portion 10 is an elastic band 11, illustrated as dotted lines; thus, while it is preferable that the loop portion 10 be made of an elastic material, it is not absolutely necessary as the elastic band 11 within loop portion 10 provides the necessary elasticity. It is preferable that the elastic band 11, in its relaxed state, have a length that equals the circumference of the narrow portion 14 so that when the engaging portion 13 is inserted through an opening 5 of the loop portion 10, the elasticity of the loop portion will cause it to tightly engage narrow portion 14. It is preferable that the length of loop portion 10 be greater than the length of the elastic band 11 inside so that when the ends of the loop portion 10 are drawn together, aesthetically pleasing creases or gathers 12 are formed in the loop portion 10. The creases 12 also provide friction between the loop portion 10 and the male or engaging portion 13 (described later) when the first end 3 and the second end 4 are connected, thus providing greater assurance of securely maintaining the connection.

The loop portion 10 is preferably fastened to the first end 3 of the band portion 2 using a single seam. Both ends of the loop portion 10 are inserted in the open first end 3 of band portion 2. The open first end 3 can be drawn together so as to form a narrow portion 14' as illustrated in the figure. A single seam can then be used to close, simultaneously, the open first end 3, the two ends of the loop portion 10, and additionally tightly connect the loop portion 10 to the band portion 2. Thus, not only is fabrication simple, but also the hairband 1 has a cleaner, more uniform look. Care must be taken, however, that both ends of the elastic band 11 are also inserted in the open end 3 so that both ends are attached at the seam.

At the second end 4 of the band portion 2 is a male engaging portion 13. This engaging portion 13 is preferably formed by wrapping at least one shape defining member 13*a* with material, preferably the same material as was used for the band portion 2. The shape defining member may be any shape found to be pleasing to the eye. However, it is preferable that the shape defining member be in the form of a sphere, as illustrated in the engaging portion 13.

It is also preferred that the shape-defining member be made from plastic. Many plastics are strong enough to assure shape retention without excessive weight. Further, plastic has the advantage that it is washable and will not change its shape when submerged in water.

Additionally, it is preferred that the material wrapped around the shape defining member extend beyond the shape defining member. In particular, by wrapping the shape defining member in a square or rectangular piece of material and allowing the material to extend beyond the shape defining member, the extra material can be inserted in the second end 4 of band part 2 and attached with a single seam, thus securely fastening the engaging portion 13 to the band portion 2. It is preferred that the material used be the same for both the band portion 2, the engaging portion 13, and the loop portion 10 because a material can be selected that will add extra friction when the loop portion 10 and the engaging portion 13 are connected, thus providing a more secure connection.

Referring now to FIG. 2, the hairband 1 is illustrated with its engaging portion 13 inserted in the loop portion 10. During the insertion, loop portion 10 was widened to accept the engaging portion 13. After the engaging portion 13 is inserted, the loop portion 10 retracts around the narrow portion 14, thereby securely fastening the ends of the hairband 1 together.

Additionally, the band portion 2 (FIG. 1) can be pulled further into the loop portion 10, causing the band portion 2 to fold or roll together. In that case, the volume of material from the band portion 2 in the loop portion 10 creates friction thereby preventing slippage.

FIG. 4 illustrates the second end 4' of another embodiment of the novel hairband. Referring to figure, the engaging portion 13' is now comprised of three spherical shape defining members 15. While the engaging portion 13' can be comprised of more than three shape defining members 15, three is preferable because they can be fastened symmetrically in the shape of a triangle.

As illustrated in FIG. 4, each of the shape defining members 15 are wrapped individually with material. This allows the user to push each shape defining member 15 of the engaging portion 13' through the loop portion 10 in sequence, providing a strong, secure connection.

While the present invention has been particularly shown and described with reference to preferred embodiments thereof, it will be understood by those skilled in the art that various changes in form and details may be made therein without departing from the spirit and scope of the invention.

What is claimed is:

1. A hairband, comprising:

an elastic band having a first end and a second end, wherein said first end is attached to an elastic loop independent of said band;

said second end includes an engaging member having a wide portion and a narrow portion; and said elastic loop in a relaxed state has an opening with a diameter smaller than said wide portion of said engaging member.

2. The hairband of claim 1, wherein said band comprises two layers of material forming a tube.

3. The hairband of claim 1, wherein said engaging member comprises a shape defining member.

4. The hairband of claim 3, wherein said shape defining member is wrapped in a material.

5. The hairband of claim 4, wherein said wrapped material extends beyond said shape defining member.

6. The hairband of claim 1, wherein said engaging member comprises at least three shape defining members.

7. The hairband of clalm 6, wherein each of said at least three shape defining members is individually wrapped in material.

8. The hairband of claim 1, wherein said loop comprises a tube having two ends and having an internal elastic band, also having two ends, positioned within said tube.

9. The hairband of claim 8, wherein both said two ends of said tube and said two ends of said internal elastic band are connected to said first end of said band.

10. The hairband of claim 8, wherein said tube comprises the same material as said band.

11. The hairband of claim 8, wherein said internal elastic band in said relaxed state has a length less than said wide portion of said engaging member, and said tube is longer than said internal elastic band.

* * * * *

UNITED STATES PATENT AND TRADEMARK OFFICE

CERTIFICATE OF CORRECTION

PATENT NO. : 5,622,194

DATED : April 22, 1997

INVENTOR(S) : Ledda-Vengerder

It is certified that error appears in the above-indentified patent and that said Letters Patent is hereby corrected as shown below:

On the title page, item [30], please delete "Germany 9403661 U" and substitute therefor -- Germany G 9403661.6--.

Signed and Sealed this

Eighth Day of July, 1997

Bruce Lehman

*Attest:*

BRUCE LEHMAN

*Attesting Officer*

*Commissioner of Patents and Trademarks*